United States Patent [19]

Brodin

[11] 4,003,550

[45] Jan. 18, 1977

[54] DEVICE IN ROPE HOISTS FOR LIMITING SPEED WHEN LOWERING A LOAD

[76] Inventor: Eric Brodin, 44, Blvd. d'Italie, Monte Carlo, Monaco

[22] Filed: July 14, 1975

[21] Appl. No.: 595,724

[30] Foreign Application Priority Data

July 18, 1974 Sweden ..... 7409420

[52] U.S. Cl. ..... 254/151; 188/72.7

[51] Int. Cl.[2] ..... B66D 5/00

[58] Field of Search ..... 254/152, 153, 154, 156, 254/157, 159, 151; 182/5, 142; 188/72.7, 72.8

[56] References Cited

UNITED STATES PATENTS

| | | | |
|---|---|---|---|
| 380,173 | 3/1888 | Bovensiep | 254/155 X |
| 612,673 | 10/1898 | Reidy et al. | 254/154 |
| 659,093 | 10/1900 | Ockers | 254/155 |
| 955,243 | 4/1910 | Witt | 254/155 |
| 1,578,108 | 3/1926 | Tobias | 254/156 |
| 2,561,832 | 7/1951 | Wilson | 254/151 X |

FOREIGN PATENTS OR APPLICATIONS

| | | | |
|---|---|---|---|
| 19,838 | 11/1904 | Austria | 182/5 |

*Primary Examiner*—Robert J. Spar
*Assistant Examiner*—Donald W. Underwood
*Attorney, Agent, or Firm*—Browdy and Neimark

[57] ABSTRACT

A device in rope hoists for limiting speed when lowering a load, comprising a rotatable drum, around which the rope is to be wound, a first friction surface on one end side of said drum, and a second friction surface, unrotatable in relation to the shaft. The friction surfaces are arranged to be moved into engagement with each other automatically in response to the load to be lowered through the use of a helical surface. The friction force between the friction surfaces is proportional to the weight of the load to be lowered.

9 Claims, 5 Drawing Figures

37
33
32
43
42
40a
36
41
39
38
40
35
34
34

DEVICE IN ROPE HOISTS FOR LIMITING SPEED WHEN LOWERING A LOAD

Background of The Invention

The present invention relates to a device in rope hoists for limiting speed when lowering a load, and is particularly intended for lowering persons from balconies and windows in buildings in case of fire or similar emergencies, when the normal building exits cannot be used.

The devices at present available for evacuating a building, for example on the outbreak of fire, are very deficient and usually consist of simple steel ladders on the outside of the building, or ordinary ropes, one end of which is attached to a wall, while the other end is thrown out of a window when occasion demands. Even if such devices may conceivably save lives, when height above ground is small and the person who is escaping has sufficient energy and is sufficiently active, it is obvious that these devices are quite inadequate for greater heights, or for persons whose energy or activity is reduced.

Furthermore, for example from U.S. Pat. 790,001 a fire escape device is known comprising a drum and curved levers which are pivotably mounted and arranged to brake the drum along its periphery. This prior art device, however, is very difficult to adjust so that the desired speed is obtained for lowering a person and is, therefore, not safe. This is due to the fact that the levers carrying the load directly engage with the drum to produce the braking force.

Summary of the Invention

The main object of the present invention is therefore to provide a device which can be used for lowering persons when evacuating buildings, even at comparatively great heights, and which is completely safe even for weak or handicapped persons. A further object is to provide a device by which even unconscious persons can be conveyed to the ground with adequate safety.

These objects are achieved according to the invention by a device comprising a rotatable drum around which the rope is to be wound at least one turn; a first friction surface on at least one end side of said drum; a second friction surface, unrotatable in relation to said drum; means for moving said first and second friction surfaces into engagement with each other automatically in response to the load, so that the friction force between said friction surfaces is proportional to the weight of the load to be conveyed.

The device according to the invention thus comprises in principle a rotatable drum, around which runs a rope, and which is automatically braked when the rope is tensioned with a weight, for example when a person is hanging on the rope, wherein the braking force is proportional to the tension in the rope. Since the braking force arises automatically and is adjusted to the load, the device may be used for both light and heavy persons, without any co-operation on their part during the downward conveyance itself. The device is initially adjusted so that an appropriate conveying speed is obtained within the conceived loading range.

In order to obtain a reliable control of the braking force, it is suitable for the friction surfaces to be relatively large, so that relatively small bearing pressures between the frictional surfaces may be used. This problem is solved according to the invention by using the outer surface of the drum end, or preferably both ends, as a friction surface. Braking is then accomplished by a brake disc being moved towards the drum end with a force proportional to the weight of the load.

Brief Description of the Drawings

The invention will now be described while referring to the attached drawings, where.

Description of the Preferred Embodiments

Figure 1:
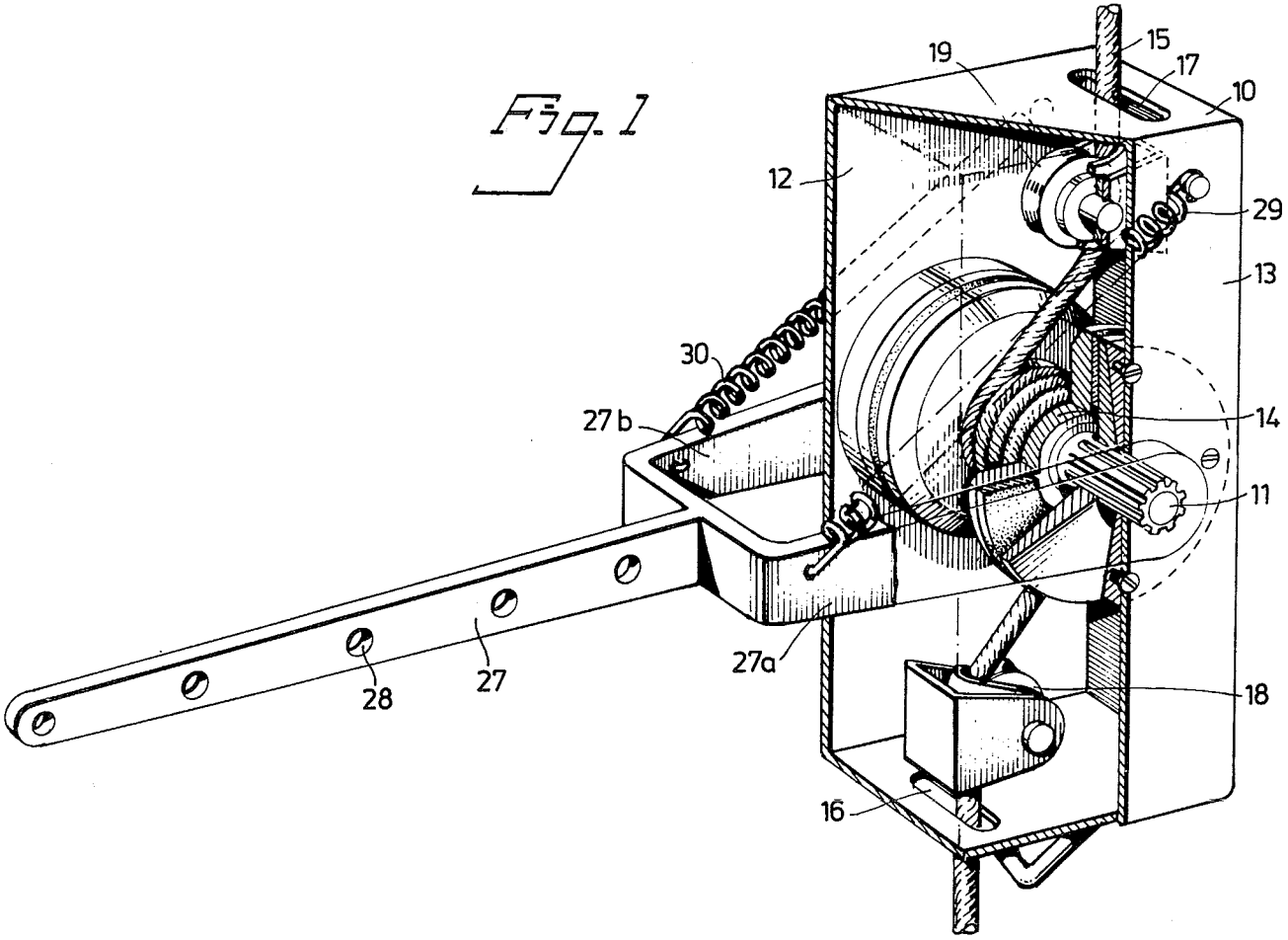
FIG. 1 shows a partially cut away perspective view of one embodiment of the invention.

The device illustrated in FIG. 1 includes a casing 10, in which a throughgoing shaft 11 is pivotably mounted in two opposing walls 12, 13 in the casing. A drum 14 is rotatably mounted on this shaft. The casing 10 is passed through by a rope 15, constituting the hoist rope. This rope passes in through a hole 16 in the bottom of the casing, and is wound a number of turns around the drum 14, and passes out through a hole 17 in the casing roof. A friction wheel 18 and 19, respectively, is arranged in the casing adjacent the inlet hole 16 and outlet hole 17, these having the function of guiding the rope through the holes and keeping the rope tensioned during its passage through the casing and round the drum.

Figure 2:
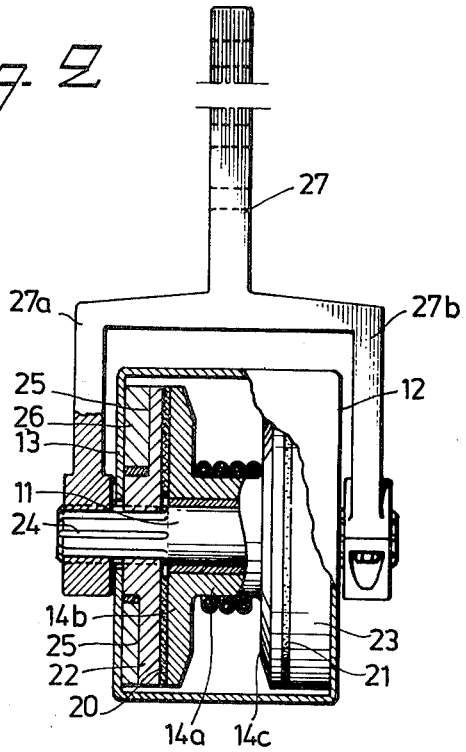
FIG. 2 shows a view from above, partly in section, of the embodiment of FIG. 1.

As more clearly seen in FIG. 2, the rotatable drum 14 consists of a hub **14*a* and two drum ends 14*b*, 14*c*, one on either side of the hub. On their outsides, the drum ends 14*b*, 14*c* are respectively provided with a layer 20 and 21** of a material having a high coefficient of friction.

A shiftable brake disc 22 and 23, respectively, is arranged adjacent each drum end. The shaft is provided at either end with external splines 24, extending all the way to the drum ends **14*b*, 14*c*. The brake discs 22, 23, shiftable on the shaft, are provided with mating internal splines preventing their rotation relative to the shaft. As may be appreciated from FIGS. 2 and 3 the surfaces of the discs 22 and 23 facing away from the drum are provided with a helically shaped surface 25 having a specific pitch. This surface 25, which is only shown for the one disc 22, coacts with a fixed abutment surface 26, attached to the inside of the adjacent casing wall, so that when the shaft 11 is turned in a specific direction the brake discs 22, 23 will be pressed against the drum ends 14*b*, 14*c*. The ends of the shaft which is pivotally mounted in the casing project a distance outside the casing walls 12, 13. A fork-shaped carrying arm 27, extending from the casing, is attached to these ends, the free prongs 27*a*, 27*b*, of the bifurcated portion being unrotatably attached to the shaft, so that the shaft 11 will be turned when the carrying arm 27** is turned about the pivoting axis. The helical surface extends over an arcuate angle at least as large as the maximum pivoting angle of the shaft, the rise of the helical surface being 0.08 – 0.3 in. (2–8 mm) preferably 0.2 in. (5 mm).

The prongs **27*a*, 27*b* of the fork-like carrying arm are each provided with a spring 29, 30**, one end of the spring being attached to the prong and the other to the casing, so that the carrying arm returns to a definite initial position in an unloaded state. In this position, the frictional force between the brake discs and the drum ends is zero or very small.

When the device is to be used for lowering a person, the upper end of the rope 15 (not shown) is attached to a balcony or window frame, and a harness or other carrying or retaining means for a person is attached to the projecting carrying arm 27. When the carrying arm 27 is loaded with the weight of the person, it turns about its pivoting axis, thereby also turning the drum shaft 11 in relation to the casing, for shifting the brake discs 22, 23 into engagement with the drum ends 14*b*, 14*c*, so that a frictional force arises between the brake discs and drum ends. The amount the arm 27 turns will be proportional to the load on the rope, and the frictional force between the brake discs and the drum ends, and thereby the braking force, will thus also be proportional to the load on the rope. The speed of lowering will thereby be substantially constant, independent of the weight of the person to be lowered.

Figure 3:
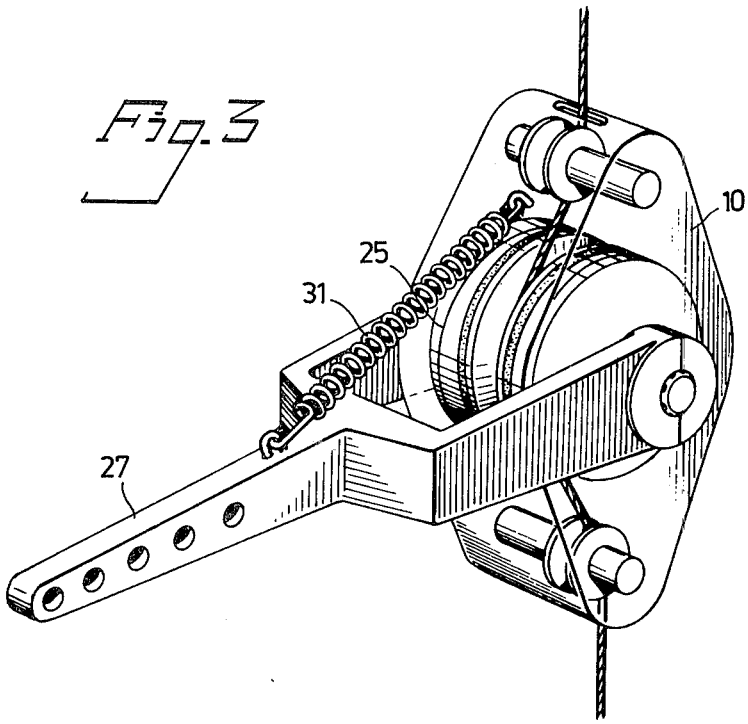
FIG. 3 shows a modification of the embodiment in FIG. 1.

In the embodiment shown in FIG. 1, the carrying arm is provided with a plurality of different holes 28, by which the carrying or retaining means for a person may be attached. By selecting different holes, different lowering speeds may be obtained, the outmost hole giving the lowest speed. A modification of the embodiment in FIG. 1 is shown in FIG. 3, the casing having been given here a more rounded shape. Furthermore, only one spring has been used for returning the carrying arm to its initial position, this spring being attached to the carrying arm at one end and to the casing at the other.

Figure 4:
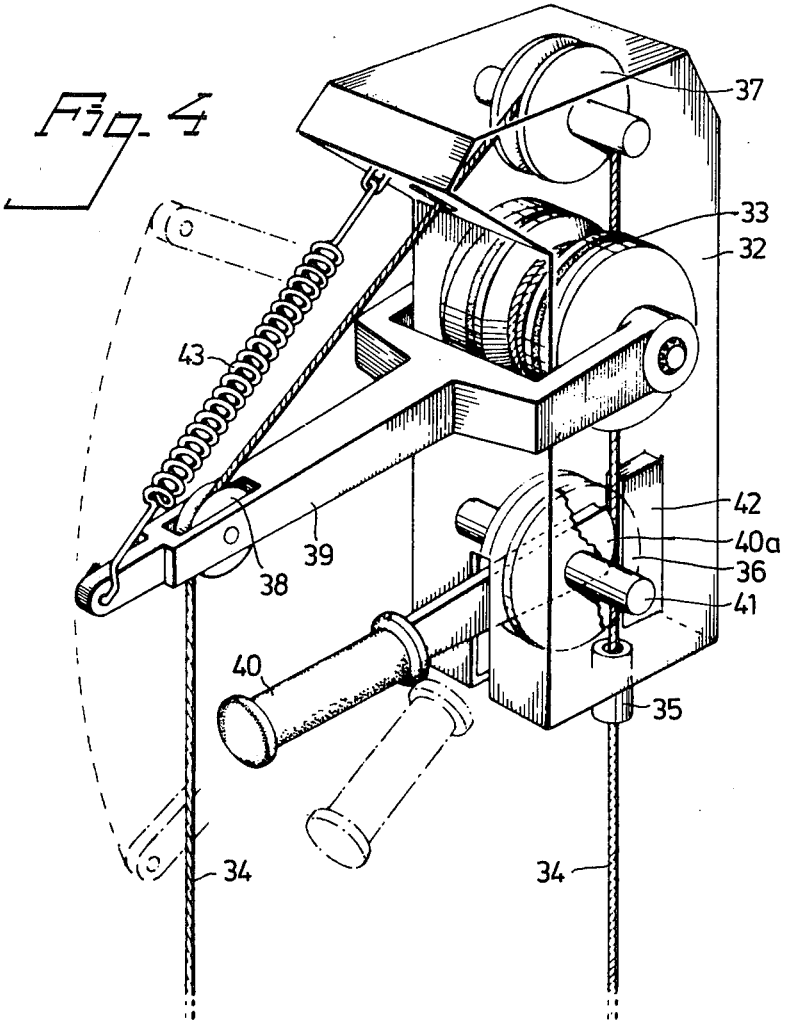
FIG. 4 shows a further embodiment of the invention, including an endless rope.
Figure 5:
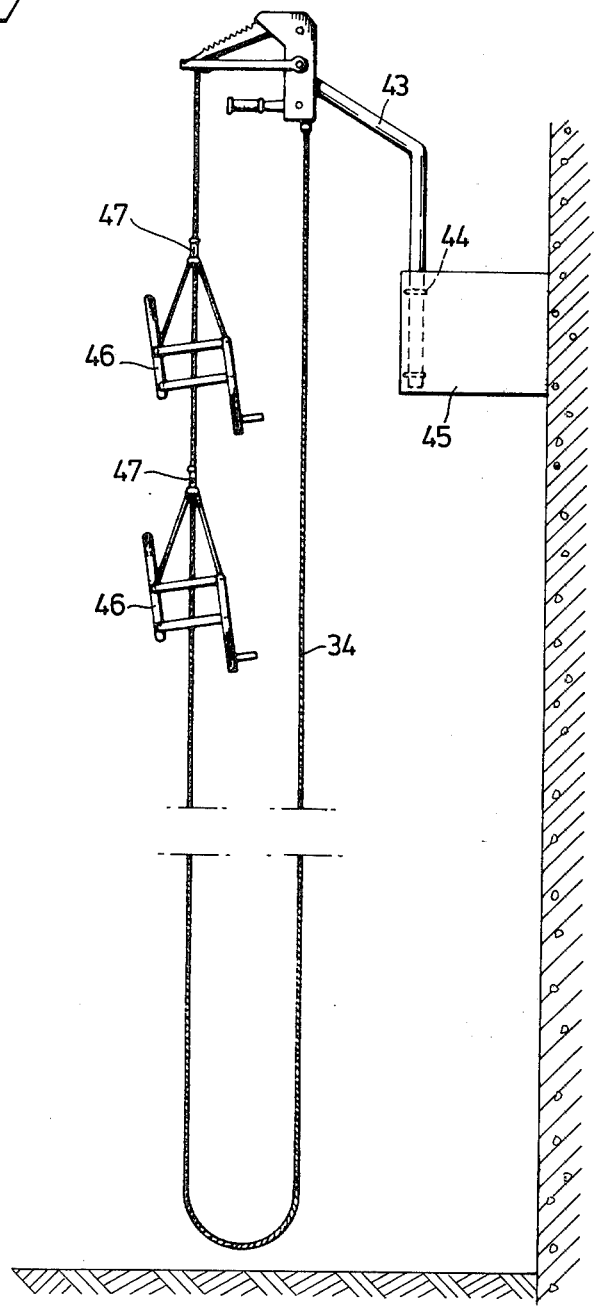
FIG. 5 shows the embodiment in FIG. 4 mounted on a balcony.

FIG. 4 schematically shows an improved embodiment of the invention. This embodiment includes a casing 32, intended for attachment to a wall or balcony as shown in FIG. 5. Similarly to the embodiment in FIG. 1, the casing is provided with a rotatable drum 33, arranged to be braked as described in connection with FIG. 1. The casing is, however, passed through by an endless rope 34, which enters at the bottom of the casing via a guide sleeve 35, passes an extra friction device 36, rounds the drum in the same way as in FIG. 1, thereafter rounds a first guiding wheel 37 and passes out of the casing to a second guiding wheel 38, positioned at the outer end of the pivotable carrying arm 39, and then runs downwardly, and then returns once more to the guide sleeve 35.

The friction device 36 consists of an operating arm 40*a*, pivotally mounted about a shaft 41. The end 40 a of the arm 40 is arranged to press the rope 34 against a grooved block 42 so that the rope is locked when the operating arm is in one position, the locking position, which is shown by full lines in FIG. 4. When the arm is in the position indicated by dashed lines, the free position, the rope is free to move through the friction device. In intermediate positions the operating arm provides varying amounts of additional braking force on the rope.

The pivotable carrying arm 39 is also in this embodiment provided with a return spring 43, attached between the outer end of the arm and the casing. Since the rope runs over a guiding wheel 38 at the outer free end of the arm, the adjustment of the arm will be dependent on the load on the rope. A normal loading position has been shown by full lines. Two further accomodating positions have been indicated by chain lines, the upper position corresponding to minimum load, and the lower one to maximum load.

Since an endless rope is used, and the casing is rigidly mounted, the cage or harness used for lowering a person must be removably attached to the rope. This can easily be done by using a clamping means known per se, which is removed from the rope at the latest on arrival at the guiding sleeve 35 at the casing inlet and attached to the leaving part of the rope.

The operating arm of the extra friction device is used to clamp the rope when somebody has to get into a cage or be fastened into a harness. The operating arm can then be used while lowering for further limiting conveying speed, in case this should be necessary or desirable.

In FIG. 5, the device in FIG. 4 is shown mounted on a jib mast 43, pivotably mounted in a holder 44, and attached to a balcony 45. The endless rope 34 is provided with two rescue chairs 46, attached to the rope with easily removably quick-release means 47. If so desired, more than two chairs may be used to obtain greater lowering capacity for the device.

To eliminating the risk of the rope 15, 34 slipping on the drum, the drum and rope should have a large mutually relative coefficient of friction. The rope may suitably consist of nylon, steel or other suitable material, with or without plastic sheathing, and may have a diameter of about 0.08 – 0.16 in. (2–4 mm), depending on material used and calculated stress.

Even if the shown and described embodiments relate to devices for lowering people in situations of emergency, it is obvious that the invention also has many other uses for lowering loads and cargo in general, for example in warehouses, stores and on similar premises, and for building repair work on buildings and other property. Many modifications of the device are possible within the scope of the invention. For example the friction layers 20, 21 can be attached to the brake discs or both to the drum ends and the brake discs, if desirable. It is not necessary to use a projecting arm for transforming the tension in the rope into a frictional force, and this can also be achieved by other means which are displaced in response to the load on the line. Thus, the rope drum can be movable in the casing against a stationary braking surface or brake pad instead of vice versa.

The shiftable brake disc can further be made with two identical helical surfaces, each on half of the disc. Each helical surface thus covers a turning angle of 180° and coacts with a fixed engaging surface. More uniform pressure distribution over the whole of the braking disc is hereby obtained.

The embodiment shown in FIG. 1 can further be easily modified so that the carrying arm has its initial position, i e the position without load, substantially at right angles to the rope and so that displacement of the arm in either direction from the normal position causes an increasing frictional force. This will give the advantage that the device can be used in both directions of the rope.

I claim:

1. A device in rope hoists for limiting speed when a lowering a load, comprising a rotatable drum around which the rope is to be wound at least one turn; a shaft, said drum being rotatably mounted on said shaft a first friction surface on at least one end side of said drum; a second friction surface, unrotatable in relation to said shaft; means for moving said first and second friction surfaces into engagement with each other automatically in response to the load, so that the friction force between said friction surfaces is proportional to the weight of the load to be conveyed; said second friction surface being a disc parallel with the frictional end side of said drum and said disc being shiftably but unrotatably mounted on said shaft; a casing in which said drum shaft is pivotably mounted; a spring-biased arm rigidly attached to said drum shaft and arranged to carry the load, so that said drum shaft is turned when the arm is turned due to the load and said friction disc on the side facing away from said drum being provided with at least one helical surface extending over an angle which is at least as great as the turning angle of said drum shaft; and a fixed abutment arranged to engage with said helical surface so that said disc is shifted towards said drum for increasing engagement with said drum friction surface when said arm is turned on being loaded.

2. A device according to claim 1, wherein said drum is provided with a friction surface on both end sides arranged to come into contact with friction surfaces which are unrotatable in relation to said drum.

3. A device according to claim 1, wherein at least one of a pair of friction surfaces is covered with a material having a high coefficient of friction.

4. A device as claimed in claim 1, wherein the rope runs through friction means both in front of and after said rope drum, said friction means being arranged to keep the rope stretched around the drum.

5. A device as claimed in claim 4, wherein one friction means is provided with an operating arm arranged to press the rope against a rigid block for enabling extra braking and for completely locking the rope.

6. A device as claimed in claim 5, especially for lowering persons from balconies and windows in buildings where there is an emergency, said device being arranged to slide along the rope, the upper end of the rope being attached to the building, and the person being carried by a carrying means attached to said load-carrying arm.

7. A device as claimed in claim 5, especially for lowering persons from balconies and windows in bulidings where there is an emergency, said device being attached to the building and the rope being made as an endless rope, passing over said load-carrying arm, the person being carried by a carrying means which has been temporarily attached to the rope by a quick-release coupling means.

8. A device as claimed in claim 1, wherein said helical surface has a rise of 0.08 – 0.3 in., preferably 0.2 in., over the turning angle of said shaft.

9. A device as claimed in claim 1, wherein said helical surface covers a turning angle of 180° of said shaft.

* * * * *